US009595213B2

(12) United States Patent
Kim

(10) Patent No.: US 9,595,213 B2
(45) **Date of Patent: *Mar. 14, 2017**

(54) ORGANIC LIGHT-EMITTING DISPLAY PANEL

(71) Applicant: SAMSUNG DISPLAY CO., LTD., Yongin, Gyeonggi-Do (KR)

(72) Inventor: Ji-Hye Kim, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 526 days.

This patent is subject to a terminal disclaimer.

(21) Appl. No.: 14/065,540

(22) Filed: Oct. 29, 2013

(65) Prior Publication Data

US 2014/0354286 A1 Dec. 4, 2014

(30) Foreign Application Priority Data

May 31, 2013 (KR) ..... 10-2013-0063078

(51) Int. Cl.
*G09G 3/00* (2006.01)
*G09G 3/32* (2016.01)

(52) U.S. Cl.
CPC ..... *G09G 3/006* (2013.01); *G09G 3/3225* (2013.01); *G09G 2300/0852* (2013.01)

(58) Field of Classification Search
CPC ..... G09G 3/006; G09G 3/22; G09G 3/30; G09G 3/32; G09G 3/3208; G09G 3/3225; G09G 3/3233; G01R 31/26; G01R 31/2601; G01R 31/2607; G01R 31/2632; G01R 31/44; H01L 22/30
See application file for complete search history.

(56) References Cited

U.S. PATENT DOCUMENTS 5,608,335 A * 3/1997 Tailliet ..... G01R 31/2831 324/750.3
7,605,599 B2 * 10/2009 Kwak ..... G09G 3/006 324/760.01
7,710,139 B2 * 5/2010 Yoshii ..... G02F 1/1303 324/760.01
8,013,816 B2 9/2011 Kim
(Continued)

FOREIGN PATENT DOCUMENTS

KR 1020040090618 10/2004
KR 1020060001532 1/2006
KR 1020080067489 7/2008

*Primary Examiner* — Huy Q Phan
*Assistant Examiner* — David Frederiksen
(74) *Attorney, Agent, or Firm* — F. Chau & Associates, LLC

(57) ABSTRACT

An organic light-emitting display panel includes a pixel unit connected to a plurality of scanning lines and a plurality of data lines, and including a plurality of pixels, a panel test unit connected to first ends of the plurality of data lines, and configured to output a panel test signal for testing the plurality of pixels, a plurality of data pads connected to second ends of the plurality of data lines, and an array test unit configured to selectively apply a plurality of array test signals to a pixel column of the pixel unit according to a plurality of array test control signals, and detect a signal output from the pixel column to which the plurality of array test signals are applied.

20 Claims, 6 Drawing Sheets

(56) References Cited

U.S. PATENT DOCUMENTS

| | | | | |
|---|---|---|---|---|
| 2005/0078057 | A1* | 4/2005 | Chang | G02F 1/13454 345/55 |
| 2006/0001792 | A1* | 1/2006 | Choi | G02F 1/13458 349/54 |
| 2007/0001711 | A1* | 1/2007 | Kwak | G09G 3/006 324/762.07 |
| 2008/0054798 | A1* | 3/2008 | Jeong | G09G 3/006 313/504 |
| 2009/0033597 | A1* | 2/2009 | Sung | G09G 3/006 345/76 |
| 2011/0080173 | A1* | 4/2011 | Kim | G09G 3/006 324/403 |
| 2013/0271440 | A1* | 10/2013 | Jin | G09G 3/006 345/211 |

* cited by examiner

ORGANIC LIGHT-EMITTING DISPLAY PANEL

CROSS-REFERENCE TO RELATED PATENT APPLICATIONS

This application claims priority under 35 U.S.C. §119 to Korean Patent Application No. 10-2013-0063078, filed on May 31, 2013, the disclosure of which is incorporated by reference herein in its entirety.

TECHNICAL FIELD

Exemplary embodiments of the present invention relate to an organic light-emitting display panel.

DISCUSSION OF THE RELATED ART

An organic light-emitting display apparatus displays an image by using a self-emission device such as an organic light-emitting diode. Due to its excellent brightness and color purity, use of the organic light-emitting display apparatus is increasing.

During manufacture of an organic light-emitting display apparatus, a tape-automated bonding (TAB) method may be used to connect a high-density integrated circuit (IC), including a driving circuit that generates and applies a scanning signal and a data signal to a pixel, to an array substrate that includes a plurality of pixels. In this case, a plurality of leads are used to connect the driving circuit to the array substrate. As a result, a process of manufacturing the organic light-emitting display apparatus may be complicated, and the reliability of the final product and the yield of the manufacturing process may be low. Additionally, the manufacturing cost of the organic light-emitting display apparatus may be high as a result of the high-density IC.

Alternatively, an organic light-emitting display apparatus of a chip-on-glass (COG) or system-on-panel (SOP) type may be used. This organic light-emitting display apparatus is manufactured by integrating a driving circuit directly into a pixel circuit array substrate in which a pixel circuit is disposed. Thus, the additional process of connecting a driving circuit to a pixel circuit array substrate may be avoided, and the reliability of the final product and yield of the manufacturing process may be improved.

SUMMARY

Exemplary embodiments of the present invention provide a panel of which defects may be detected at an early time after an array process is performed.

According to an exemplary embodiment of the present invention, an organic light-emitting display panel includes a pixel unit which is located at a crossing area between scanning lines and data lines, and in which a plurality of pixels that display different colors from each other are formed, a panel test unit that is connected to an end of the data lines, and after an organic light-emitting device is formed in the pixel unit, outputs a panel test signal for testing the pixels, a plurality of data pads that are respectively connected to lines which extend from other end of the data lines, an array test unit that selectively applies array test signals to a pixel column of the pixel unit according to a plurality of array test control signals, and senses a current which is output from the pixel column to which the array test signals are applied, thereby testing a pixel circuit array before the organic light-emitting device is formed in the pixel unit, and a line test unit that outputs a line test signal for testing an occurrence of a short and an open in the lines which extend from the other end of the data lines.

The plurality of array test control signals may include the panel test signal and the line test signal.

The array test unit may include a plurality of array test pads that contact a probe pin in an array test apparatus and receive the array test signals, and a demultiplexer that connects one array test pad to the plurality of data pads, and according to the plurality of array test control signals, selectively transmits the array test signal to the data pads.

The demultiplexer may include a plurality of array test switches having a gate connected to one of a plurality of lines that transmit the plurality of array test control signals, a first terminal connected to one of the plurality of data pads, and a second terminal connected to one of the plurality of array test pads.

The plurality of array test switches may include first array test switches of which gates are connected in common to a line that supplies a first array test control signal, second array test switches of which gates are connected in common to a line that supplies a second array test control signal, third array test switches of which gates are connected in common to a line that supplies a third array test control signal, and fourth array test switches of which a gates are connected in common to a line that supplies a fourth array test control signal.

The demultiplexer may include a plurality of switch groups that connect sequential data pads to one array test pad, a number of the sequential data pads being the same as a number of the array test control signals, each switch group including a plurality of array test switches having a gate connected to a line that supplies each of the array test control signals, and the plurality of array test switches in each switch group are sequentially turned on, in response to the array test control signal.

The line test unit may include a plurality of line test switches of which gates are connected in common to a line that supplies a line test control signal, first terminals respectively are connected to the array test pads, and second terminals receive a line test signal.

The line test unit may be maintained in an OFF state while the array test unit executes an array test.

The organic light-emitting display panel may further include a data switch unit that selectively applies data signals, which are output from the data pads, to a pixel column of the pixel unit.

The organic light-emitting display panel may further include a data driving unit that is bonded to the data pads using a chip-on-glass (COG) method, and applies data signals to the data lines.

According to an exemplary embodiment of the present invention, an organic light-emitting display panel includes a plurality of array test pads that, in order to test a pixel circuit array before an organic light-emitting device is formed in a pixel unit, contact a probe pin in an array test apparatus and receive an array test signal, and a demultiplexer that is disposed between a plurality of data pads, which are connected respectively to lines that extend from data lines of the pixel unit, and the plurality of array test pads, and according to a plurality of array test control signals, selectively applies the array test signal, which is output from the array test pads, to a pixel column of the pixel unit via the data pads.

The plurality of array test control signals may include a panel test signal that is output from a panel test unit which, after an organic light-emitting device is formed in the pixel unit, tests pixels, and a line test signal that is output from a line test unit which tests an occurrence of a short and an open in lines which extend from the data lines.

The demultiplexer may include a plurality of array test switches having a gate connected to one of a plurality of lines that supply the plurality of array test control signals, a first terminal connected to one of the plurality of data pads, and a second terminal connected to one of the plurality of array test pads.

The plurality of array test switches may include first array test switches of which gates are connected in common to a line that supplies a first array test control signal, second array test switches of which gates are connected in common to a line that supplies a second array test control signal, third array test switches of which gates are connected in common to a line that supplies a third array test control signal, and fourth array test switches of which gates are connected in common to a line that supplies a fourth array test control signal.

The demultiplexer may include a plurality of switch groups that connect sequential data pads to one array test pad, a number of the sequential data pads being the same as a number of the array test control signals, and each switch group may include a plurality of array test switches having a gate connected to a line that supplies each of the array test control signals, and the plurality of array test switches in each switch group is sequentially turned on in response to the array test control signal.

The array test pad may have a larger size than the data pad, and a space between the array test pads may be wider than a space between the data pads.

The line test unit may include a plurality of line test switches of which gates are connected in common to a line that supplies a line test control signal, first terminals are respectively connected to the array test pads, and second terminals receive the line test signal.

The line test unit may be maintained in an OFF state while an array test is executed.

The organic light-emitting display panel may further include a data switch unit that selectively applies data signals, which are output from the data pads, to pixel columns of the pixel unit.

The organic light-emitting display panel may further include a data driving unit that is bonded to the data pads by using a chip-on-glass (COG) method, and applies data signals to the data lines.

According to an exemplary embodiment of the present invention, an organic light-emitting display panel includes a pixel unit connected to a plurality of scanning lines and a plurality of data lines, and including a plurality of pixels, a panel test unit connected to first ends of the plurality of data lines, and configured to output a panel test signal for testing the plurality of pixels, a plurality of data pads connected to second ends of the plurality of data lines, and an array test unit configured to selectively apply a plurality of array test signals to a pixel column of the pixel unit according to a plurality of array test control signals, and detect a signal output from the pixel column to which the plurality of array test signals are applied.

According to an exemplary embodiment of the present invention, an organic light-emitting display panel includes a plurality of array test pads configured to contact a probe pin of an array test apparatus and receive an array test signal, and a demultiplexer disposed between a plurality of data pads and the plurality of array test pads, and configured to selectively apply the array test signal to a pixel column of a pixel unit via the plurality of data pads according to a plurality of array test control signals. The plurality of data pads are connected to a plurality of data lines of the pixel unit, and the array test signal is output by the plurality of array test pads.

According to an exemplary embodiment of the present invention, an organic light-emitting display panel includes a panel test unit connected to first ends of a plurality of data lines, and configured to output a plurality of panel test signals for testing a plurality of pixels in the organic light-emitting display panel, a plurality of data pads connected to second ends of the plurality of data lines, and an array test unit configured to selectively apply a plurality of array test signals to pixel columns including the plurality of pixels according to a plurality of array test control signals. The array test unit includes a plurality of array test pads configured to contact a probe pin of an array test apparatus and receive the plurality of array test signals. Each of the plurality of array test pads has a larger size than each of the plurality of data pads, and a space between each of the plurality of array test pads is wider than a space between each of the plurality of data pads. The plurality of array test control signals include the plurality of panel test signals.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EXEMPLARY EMBODIMENTS

Figure 1:
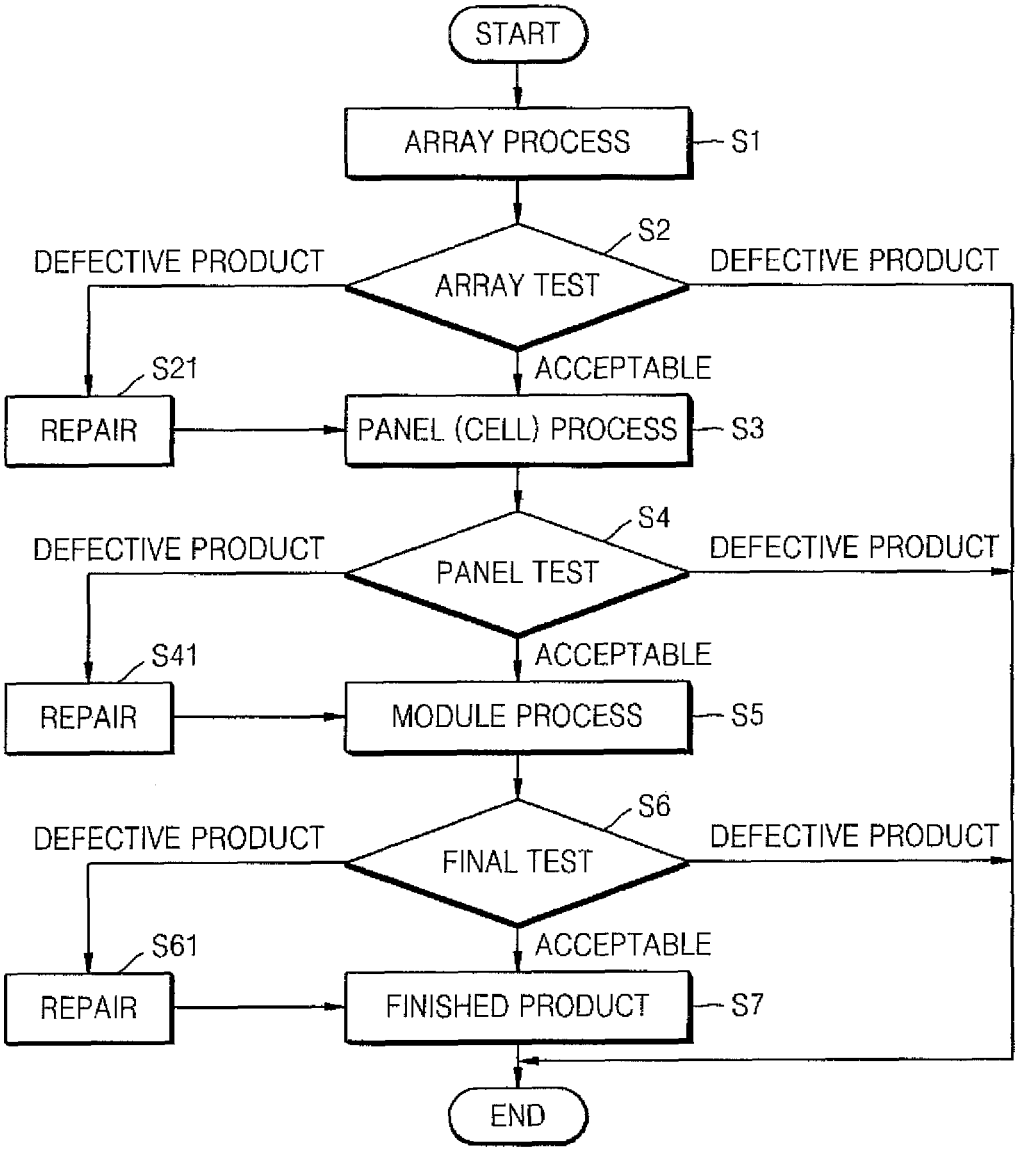
FIG. 1 is a flowchart illustrating a method of manufacturing an organic light-emitting display apparatus, according to an exemplary embodiment of the present invention.

Exemplary embodiments of the present invention will be described more fully hereinafter with reference to the accompanying drawings. Like reference numerals may refer to like elements throughout the accompanying drawings.

It will be understood that the terms "includes," and/or "including," when used herein, specify the presence of components, but do not preclude the presence or addition of one or more other components. Additionally, when an object is referred to as being "on" another object, the object can be located above or below another object, and the object may be located directly or indirectly on another object.

FIG. 1 is a flowchart illustrating a method of manufacturing an organic light-emitting display apparatus, according to an exemplary embodiment of the present invention.

At operation S1, an array process that forms a pixel circuit array on a substrate is performed. A pixel circuit in the pixel circuit array may include, for example, two or more thin-film transistors (TFTs) and one or more capacitors. At operation S2, an array test that detects whether the pixel circuit array is defective is performed. The array test S2 determines whether the TFT operates normally. A pixel circuit determined as being defective in the array test S2 undergoes a repair process at operation S21. If the defective pixel circuit cannot be repaired, no further operation is performed.

If the pixel circuit array is determined as being free of defects, or if a defective pixel circuit is repaired, the product is considered to be acceptable, and a panel (cell) process is performed at operation S1 In the panel (cell) process, an anode electrode, an organic emissive layer, and a cathode electrode may be formed, and the manufacture of an organic light-emitting device (OLED) is finished. A panel test is then performed at operation S4. The panel test performed at operation S4 may include, for example, a panel lighting test, a leakage current test, and/or an aging test. A panel which is determined as being defective in the panel test S4 undergoes a repair process at operation S41. If the panel cannot be repaired, no further operation is performed.

If the panel is determined as being free of defects, or if the defective panel is repaired, the product is considered to be acceptable, and a module process that forms a module is performed at operation S5. A final test is executed at operation S6 to determine whether the module is defective. A module which is determined as being defective in the final test S6 may undergo a repair process at operation S61. If the module cannot be repaired, no further operation is performed. The method of manufacturing an organic light-emitting display apparatus according to FIG. 1 is completed at operation S7.

According to an exemplary embodiment of the present invention, after the array process S1 is performed, the array test S2 is performed to detect whether the TFT is defective. Accordingly, a defect in the pixel circuit array may be repaired, and thus, a manufacturing yield may be improved. Additionally, if the defective pixel circuit array cannot be repaired, the panel (cell) process S3 and the module process S5 may not be executed. Thus, manufacturing cost and time may be saved.

Figure 2:
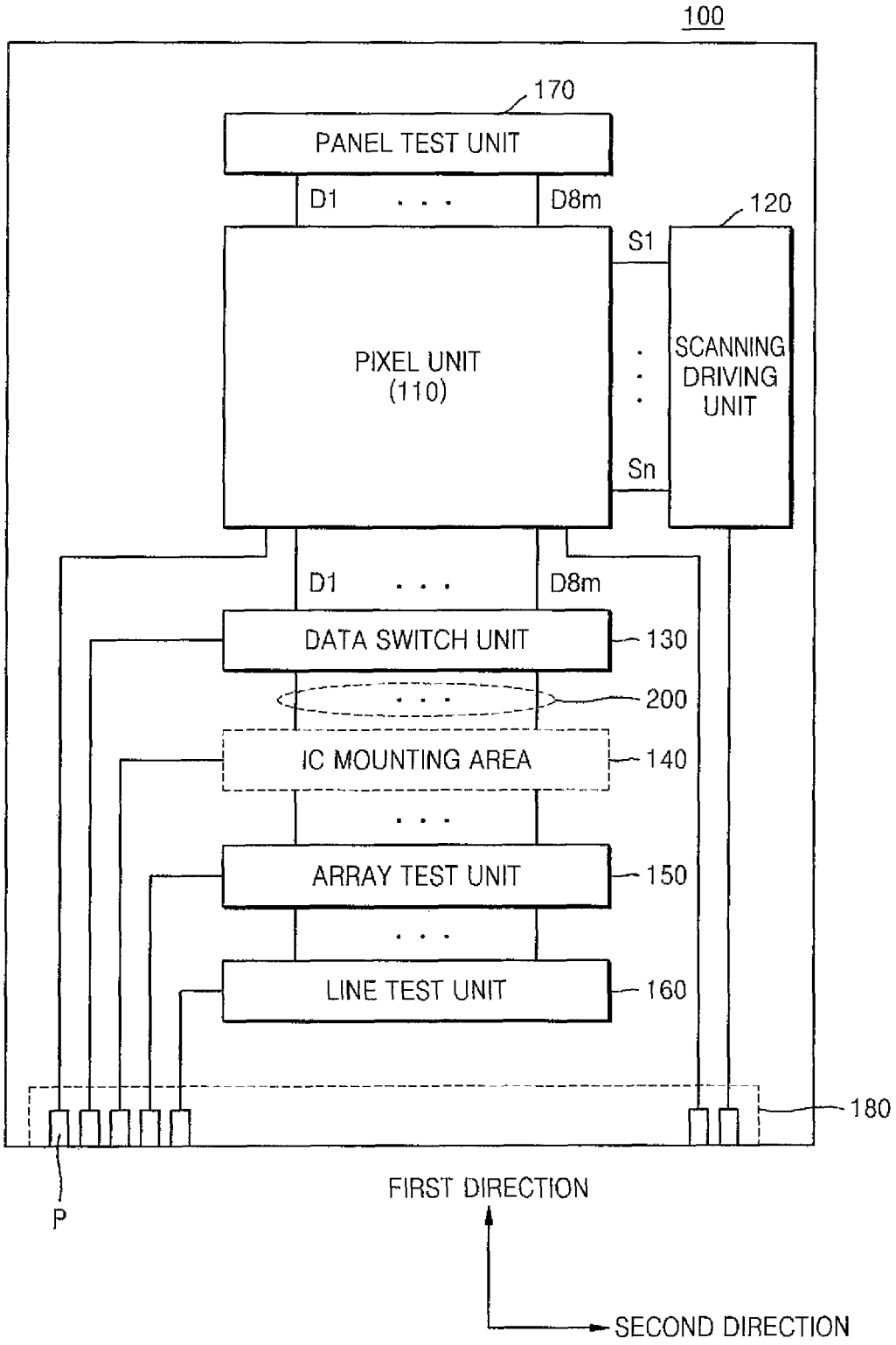
FIG. 2 is a schematic plan view illustrating an organic light-emitting display panel, according to an exemplary embodiment of the present invention.

FIG. 2 is a schematic plan view illustrating an organic light-emitting display panel 100, according to an exemplary embodiment of the present invention.

Referring to FIG. 2, according to an exemplary embodiment of the present invention, the organic light-emitting display panel 100 includes a pixel unit 110, a scanning driving unit 120, a data switch unit 130, an integrated circuit (IC) mounting area 140, an array test unit 150, a line test unit 160, a panel test unit 170, and a pad unit 180.

The pixel unit 110 is located in a crossing area between data lines D1 through D8*m* and scanning lines S1 through Sn. The pixel unit 110 includes first pixels, second pixels, and third pixels that respectively emit light of different colors. The data lines D1 through D8*m* extend in a first direction, and the scanning lines S1 through Sn extend in a second direction.

The scanning driving unit 120 generates a scanning signal in correspondence to scanning driving power sources VDD and VSS and a scanning control signal SCS (shown in FIGS. 4 through 6), and sequentially supplies the scanning signal to the scanning lines S1 through Sn.

The data switch unit 130 is connected to the data lines D1 through D8*m*. The data switch unit 130 may reduce a size of the IC that is mounted in the IC mounting area 140. The data switch unit 130 may include, for example, a demultiplexing circuit that includes a plurality of switching devices. The data switch unit 130 is maintained in an OFF state when the panel test S4 is executed, thereby electrically insulating a data driving unit from the pixel unit 110.

A plurality of data pads, which are respectively connected to the data lines, e.g., via lines that extend from the data lines D1 through D8*m* in the pixel unit 110, are disposed in the IC mounting area 140. The data driving unit may be bonded to the data pads using, for example, a chip-on-glass (COG) method, and may be mounted in the IC mounting area 140. The data driving unit generates a data signal in correspondence to display data DATA and a data control signal DCS, and transmits the data signal to the data lines D1 through D8*m*. The data switch unit 130 selectively applies a data signal, which is output from the data driving unit, to a pixel column of the pixel unit 110.

The array test unit 150 tests whether the TFT and the capacitor, which are formed in each pixel in the pixel unit 110, are defective. The array test unit 150 may include, for example, a demultiplexing circuit that includes a plurality of switching devices. During the array test S2, the array test unit 150 receives an array test signal and an array test control signal (e.g., direct current (DC) signals), and in correspondence to the array test control signal, selectively supplies the array test signal to a pixel column of the pixel unit 110.

The line test unit 160 detects a short or an open at the data lines D1 through D8*m*. For example, the line test unit 160 may detect a short or open in lines that are disposed in a fan-out unit 200, e.g., lines that extend from the data lines D1 through D8*m* of the pixel unit 110 to the IC mounting area 140. The line test unit 160 receives the line test signal and the line test control signal (e.g., DC signals), and in correspondence to the line test control signal, transmits the line test signal to lines that are disposed in the fan-out unit 200. The line test unit 160 is in an OFF state during the array test S2. After the array test S2, the line test unit 160 may execute a short/open test on the lines in the fan-out unit 200 in the panel test S4.

The panel test unit 170 is connected to the data lines D1 through D8*m*. While the panel test S4 is executed, the panel test unit 170 receives a panel test signal and a panel test control signal (e.g., DC signals), and in correspondence to the panel test control signal, transmits the panel test signal to the data lines D1 through D8*m*. The panel test unit 170 is in an OFF state during the array test S2.

The pad unit 180 includes a plurality of pads P that transmit powers and/or signals, which may be supplied externally from the organic light-emitting display panel 100, to the inside of the organic light-emitting display panel 100. In the exemplary embodiment of FIG. 1, one line is shown as connecting each pad P to each element inside the panel 100. However, the number of lines connecting the pads P is not limited thereto. For example, a plurality of lines may be provided from each pad P. For example, in an exemplary embodiment, five lines may be used to transmit signals from each pad P of the pad unit 180 to the scanning driving unit 120, and the signals may include the scanning driving power sources VDD/VSS, a start pulse SP as a scanning control signal SCS, a scanning clock signal CLK, and an output enable signal OE.

According to an exemplary embodiment of the present invention, the organic light-emitting display panel 100 may further include a light-emitting control unit that applies a light-emitting control signal to the pixel unit 110, allowing for sufficient test signals to be applied to the first, second, and third pixels during the panel test S4.

Figure 3:
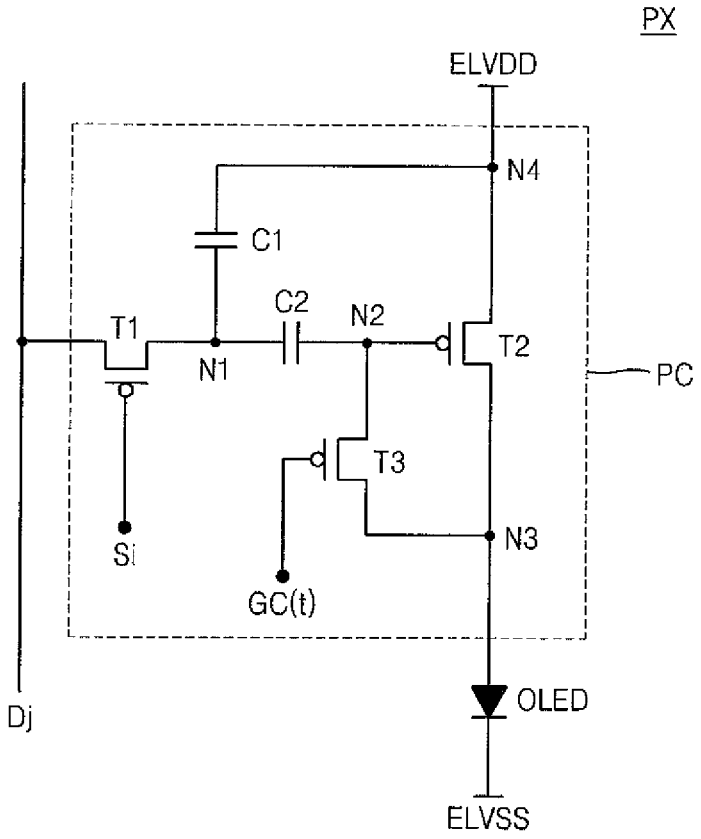
FIG. 3 is an equivalent circuit diagram of a unit pixel in the organic light-emitting display panel that may be tested by using an array test method, according to an exemplary embodiment of the present invention.

FIG. 3 is an equivalent circuit diagram of a unit pixel in the organic light-emitting display panel that may be tested using an array test method, according to an exemplary embodiment of the present invention. Each pixel PX includes an organic light-emitting device OLED and a pixel circuit PC that supplies a current to the light-emitting device OLED.

A first thin-film transistor (TFT) T1 is a switching transistor. A gate of the first TFT T1 is connected to a scanning line and receives a scanning signal Si, a first terminal of the first TFT T1 is connected to a data line and receives a data signal Dj, and a second terminal of T1 is connected to a first node N1.

A second TFT T2 is a driving transistor. A gate of the second TFT T2 is connected to a second node N2, a first terminal of the second TFT T2 is connected to a fourth node N4 and receives a first driving voltage ELVDD, and a second terminal of the second TFT T2 is connected to an anode electrode of the organic light-emitting device OLED and a first terminal of a third TFT T3 at a third node N3.

A gate of the third TFT T3 receives a control signal GC(t) that compensates for a threshold voltage of the second TFT T2. A first terminal of the third TFT T3 is connected to the second terminal of the second TFT T2 at the third node N3, and a second terminal of the third TFT T3 is connected to the gate of the second TFT T2 and a second capacitor C2.

A first capacitor C1 is connected between the first node N1 and the fourth node N4, and stores a data signal that is applied to the gate of the first TFT T1. The second capacitor C2 is connected between the first node N1 and the second node N2, and adjusts a threshold voltage of the first TFT T1.

An anode electrode of the organic light-emitting device OLED, which is a pixel electrode, is connected to the second terminal of the second TFT T2 and the first terminal of the third TFT T3 at the third node N3. A cathode electrode, which is a common electrode, receives the second driving voltage ELVSS.

In response to the scanning signal Si, the first TFT T1 transmits the corresponding data signal Dj to the gate of the second TFT T2. In response to the data signal Dj that is transmitted to the gate via the first TFT T1, the second TFT T2 transmits a driving current to the organic light-emitting device OLED. In response to the control signal GC(t), the third TFT T3 compensates for the threshold voltage of the second TFT T2.

FIG. 3 illustrates a "3T2C" (e.g., three-transistor, two-capacitor) structure of a pixel circuit PC. However, the array test method in the present invention is not limited to being applied to a 3T2C structure. For example, the array test method may be applied to a "2T1C" (e.g., two-transistor, one-capacitor) pixel circuit in which the third TFT T3 and the second capacitor C2 are not provided. Alternately, the array test method in the present invention may also be applied to a pixel circuit in which transistors and capacitors which substitute the third TFT T3 and the second capacitor C2 are variously combined.

Additionally, although FIG. 3 shows a p-channel metal oxide semiconductor (PMOS) TFT, exemplary embodiments are not limited thereto. For example, an n-channel metal oxide semiconductor (NMOS) TFT may also be employed. In this case, a waveform of a signal that drives the transistors and capacitors may be reversed.

According to an exemplary embodiment of the present invention, the pixel circuit PC is formed in the pixel unit 110, and before the organic light-emitting device OLED is formed, the array test S2 may be performed to detect whether the pixel circuit PC is defective.

Figure 4:
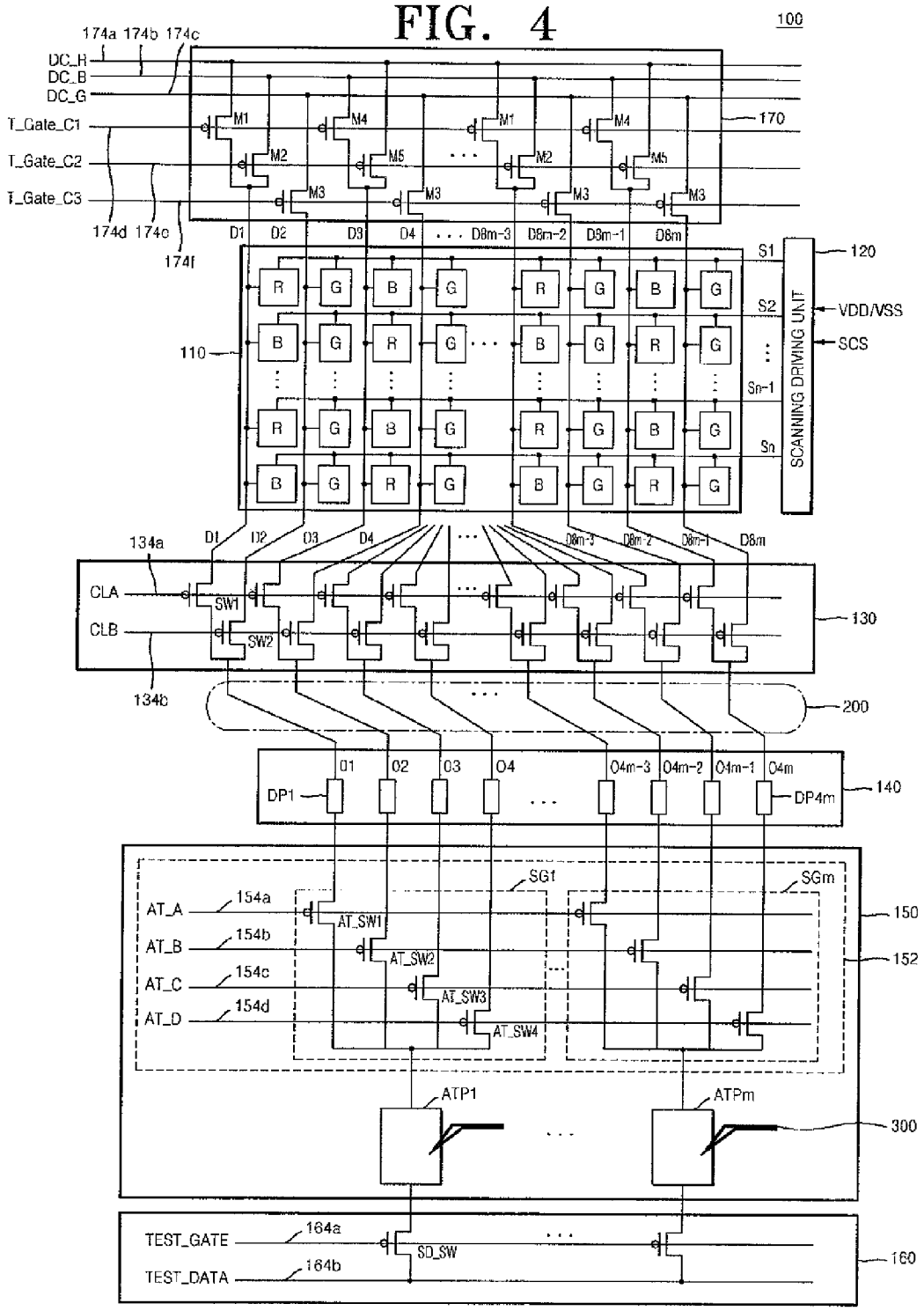
FIG. 4 is a plan view illustrating an exemplary embodiment of the organic light-emitting display panel of FIG. 2.

FIG. 4 is a plan view illustrating an exemplary embodiment of the organic light-emitting display panel of FIG. 2.

Referring to FIG. 4, the pixel unit 110 has a structure in which the first, second, and third pixels that emit light of respectively different colors are included. The first and second pixels are alternately arranged in the same column, and the third pixels are disposed in-line in a column that is adjacent to the column in which the first and second pixels are arranged. As illustrated in FIG. 3, each pixel includes the pixel circuit PC.

As shown in FIG. 4, the first pixels are red pixels R that emit red light, the second pixels are blue pixels B that emit blue light, and the third pixels are green pixels G that emit green light.

The red pixels R and the blue pixels B are alternately arranged in the same column. The green pixels G, which are pixels of a color that is sensitive to the resolution, are disposed in-line in a column adjacent to the column in which the red pixels R and the blue pixels B are arranged.

The red pixels R and the blue pixels B are arranged in a checkerboard pattern, in a diagonal direction to each other with the green pixels G disposed therebetween. For example, the red pixels R and the blue pixels B are alternately disposed so that the red pixels R and the blue pixels B are not repeatedly arranged in the same column in the two neighboring rows.

According to an exemplary embodiment of the present invention, the pixel unit 110 includes the red pixels R, the blue pixels B, and the green pixels G. However, the pixel unit 110 is not limited thereto. For example, the pixel unit 110 may further include a pixel(s) displaying a color(s) other than red, green, or blue.

The data switch unit 130 is disposed between the data lines D1 through D8*m* and output lines O1 through O4*m* of the data pads DP in the IC mounting area 140. The data pads DP are bonded to the data driving unit, which is disposed in the IC mounting area 140. Lines that supply a signal from the pad unit 180 to the data switch unit 130 may include, for example, two lines 134*a* and 134*b* that receive a first data control signal CLA and a second data control signal CLB. The data switch unit 130 includes first data switches SW1 and the second data switches SW2. The first data switches SW1 are disposed between odd-numbered data lines D1, D3, . . . , D8*m*−1 in a column in which the red pixels R and the blue pixels B are alternately arranged and the output lines O1 through O4*m*, and the second data switches SW2 are disposed between even-numbered data lines D2, D4, . . . , D8*m* in a column in which the green pixels G are arranged and the output lines O1 through O4*m*. Gates of the first data switches SW1 are connected in common to a line 134*a* that supplies the first data control signal CLA. Each of the first terminals are connected to each of the odd-numbered data lines D1, D3, . . . , D8*m*−1. Each of the second terminals are connected to each of the output lines O1 through O4*m*. Gates of the second data switches SW2 are connected in common to a line 134*b* that supplies the second data control signal CLB. Each of the first terminals are connected to each of the even-numbered data lines D2, D4, . . . , D8*m*, and each of the second terminals are connected to each of the output lines O1 through O4*m*.

During the panel test S4, the first data switches SW1 and the second data switches SW2 in the data switch unit 130 receive the first data control signal CLA and the second data control signal CLB for maintaining an OFF state via the pad unit 180, and correspondingly, and the data switch unit 130 is maintained in an OFF state. After the panel test S4 is finished, while the organic light-emitting display panel 100 is driven to display an image, the data switch unit 130 receives the first data control signal CLA and the second data control signal CLB for maintaining an ON state via the pad unit 180, and thus, is alternately turned on. Then, the data switch unit 130 transmits a data signal, which is supplied from the data driving unit in the IC mounting area 140, to the data lines D1 through D8*m*. Additionally, during the array test S2, the first data switches SW1 and the second data switches SW2 in the data switch unit 130 are alternately or simultaneously turned on, according to the first data control signal CLA and the second data control signal CLB for maintaining an ON state via the pad unit 180. Then, the first data switches SW1 and the second data switches SW2 transmit the array test signal AT_DATA, which is supplied from the array test pads ATP via a probe pin(s) 300, to the data lines D1 through D8*m*.

The array test unit 150 is disposed between data pads DP1 through DP4*m* in the IC mounting area 140 and the line test unit 160. The array test unit 150 includes a demultiplexer 152 and a plurality of array test pads ATP1 through ATPm. Lines which supply signals from the pad unit 180 to the array test unit 150 may include four lines 154*a* through 154*d* that receive first through fourth array test control signals AT_A through AT_D.

The demultiplexer 152 includes a plurality of switch groups SG1 through SGm, and each of the switch groups SG1 through SGm includes a plurality of array test switches AT_SW1 through AT_SW4. A first terminal of each of the array test switches AT_SW1 through AT_SW4 is connected to data pads DP1 through DP4*m*, and a second terminal thereof is connected to array test pads ATP1 through ATPm. The array test switches AT_SW1 through AT_SW4 in each of the switch groups SG1 through SGm connect sequential data pads DP to one array test pad ATP, a number of the sequential data pads DP being the same as a number of the array test control signals AT_A through AT_D. Accordingly, the number of the array test pads ATP may be reduced to be smaller than the number of the data pads DP. Thus, a size of the array test pads ATP and a space between the array test pads ATP may be increased. In an exemplary embodiment according to FIG. 4, each of the switch groups. SG1 through SGm connects four data pads DP to one array test pad ATP. Thus, the number of the array test pads ATP may be reduced to ¼ of the number of data pads DP.

The first array test switches AT are connected to the first data pads DP1, DP5, . . . , DP4*m*−3. Gates of the first array test switches AT_SW1 are connected in common to the line 154*a* that supplies the first array test control signal AT_A. The second array test switches AT_SW2 are connected to the second data pads DP2, DP6, . . . , DP4*m*−2. Gates of the second array test switches AT_SW2 are connected in common to the line 154*b* that supplies the second array test control signal AT_B. The third array test switches AT_SW3 are connected to the third data pads DP3, DP7, DP4*m*−1. Gates of the third array test switches AT_SW3 are connected in common to the line 154*c* that supplies the third array test control signal AT_C. The fourth array test switches AT_SW4 are connected to the fourth data pads DP4, DP8, . . . , DP4*m*. Gates of the fourth array test switches AT_SW4 are connected in common to the line 154*d* that supplies the fourth array test control signal AT_D.

The array test pads ATP1 through ATPm are pads that contact a probe pin(s) 300 of an array test apparatus. The data pads DP are small relative to the array test pads ATP, and a space between the data pads DP is narrow relative to the space between the array test pads ATP. Thus, the data pads DP may not contact the probe pin(s) 300 of the array test apparatus on a one-to-one basis. On the contrary, according to exemplary embodiments of the present invention, the array test pads ATP may be formed to have a larger size and a larger space between the array test pads ATP relative to the size and space between the data pads DP, by using the array test switches AT_SW1 through AT_SW4. Accordingly, the array test pads ATP may contact the probe pin(s) 300 of the array test apparatus on a one-to-one basis, and thus, the array test S2 can be executed. The array test pads ATP receive an array test signal AT_DATA from the probe pin(s) 300 of the array test apparatus, transmits the array test signal AT_DATA to the pixel unit 110, and receives signals (e.g., currents) from the pixel unit 110.

The line test unit 160 includes a plurality of line test switches SD_SW. Gates of the line test switches SD_SW are connected in common to a line 164*a* that supplies a line test control signal TEST_GATE. A first terminal of each of the line test switches SD_SW is connected to the array test pads ATP, and a second terminal thereof is connected in common to a line 164*b* that supplies a line test control signal TEST_DATA.

The line test switches SD_SW of the line test unit 160 receive the line test control signal TEST_GATE for maintaining a turned-off state during the array test S2, and correspondingly, the line test unit 160 is maintained in a turned-off state. During the panel test S4 after the array test S2, the line test unit 160 may execute a short or open test on lines in the fan-out unit 200.

The panel test unit 170 includes a plurality of switches M1 through M5 that are connected to the data lines D1 through D8*m*. For example, the panel test unit 170 includes first panel test switches M1 that are connected between each of the first data lines D1, D8*m*−3 and a first panel test signal line 174*a*, second panel test switches M2 that are connected between each of the first data lines D1, D5, D8*m*−3 and a second panel test signal line 174*b*, fourth panel test switches M4 that are connected between each of the second data lines D3, D7, . . . , D8*m*−1 and the second panel test signal line 174*b*, fifth panel test switches M5 that are connected between each of the second data lines D3, D7, . . . , D8*m*−1 and the first panel test signal line 174*a*, and third panel test switches M3 that are connected between each of the third data lines D2, D4, . . . , D8*m* 1 and a third panel test signal line 174*c*. The first panel test signal line 174*a*, the second panel test signal line 174*b*, and the third panel test signal line 174*c*, as described herein, are lines that respectively receive panel test signals including, for example, a red test signal DC_R, a blue test signal DC_B, and a green test signal DC_G (e.g., DC signals) from the pad unit 180 during the panel test S4. The red test signal DC_R, the blue test signal DC_B, and the green test signal DC_G are supplied to each of the data lines D1 through D8*m* via the panel test unit 170.

Gates of the first panel test switches M1 and the fourth panel test switches M4 are connected in common to a line 174*d* that supplies a first panel test control signal T_Gate_C1. Gates of the second panel test switches M2 and the fifth panel test switches M5 are connected in common to a line 174*e* that supplies a second panel test control signal T_Gate_C2. Gates of the third panel test switches M3 are connected in common to a line 174*f* that supplies a third panel test control signal T_Gate_C3.

The red pixels R and the blue pixels B are connected to one data line. Thus, the first panel test switches M1 and the fourth panel test switches M4, and the second panel test switches M2 and the fifth panel test switches M5, are alternately turned on/off, according to a first panel test control signal T_Gate_C1 and a second panel test control signal T_Gate_C2, so that a red test signal DC_R and a blue test signal DCB are supplied respectively to the red pixels R and the blue pixels B.

While the panel test S4 is executed, panel test control signals T_Gate (e.g., DC signals) for maintaining the first through fifth panel test switches M1 through M5 in a turned-on state are supplied to the gates of the first through fifth panel test switches M1 through M5. Accordingly, while being maintained in a turned-on state, the first through fifth panel test switches M1 through M5 transmit the red test signal DC_R, the blue test signal DC_B, and the green test signal DC_G, which are supplied from the first through third panel test signal lines 174*a* through 174*c*, respectively to the first data lines D1, D5, D8*m*−3, the second data line D3, D7, . . . , D8*m*−1, and the third data line D2, D4, . . . , D8*m*.

The scanning driving power sources VDD/VSS and the scanning control signal SCS are transmitted to the scanning driving unit 120. The scanning driving unit 120 may then sequentially generate scanning signals and transmit the scanning signals to the pixel unit 110. Accordingly, pixels which receive the scanning signal and the panel test signal emit light to display an image, and thus, a lighting test may be executed.

In an exemplary embodiment of the present invention, the switches M1 through M5, SW1 and SW2, AT_SW1 through AT_SW4, and SD_SW are all PMOS transistors. However, exemplary embodiments of the present invention are not limited thereto. For example, all of the switches described above may be NMOS transistors or transistors of different conductive types from each other.

Hereinafter, referring to FIG. 4, the array test S2 according to an exemplary embodiment of the present invention is described.

Once the array process S1 is finished, the array test pad ATP in a panel 100 may be contacted by a plurality of probe pin(s) 300 of an array test apparatus. The array test apparatus applies an array test signal AT-DATA (e.g., a test voltage) to the probe pin(s) 300. The line test switches SD-SW of the line test unit 160 are in a turned-off state. The first through fourth array test switches AT_SW1 through AT_SW4 are sequentially turned on, and the first and second data switches SW1 and SW2 in the data switch unit 130 are sequentially or simultaneously turned on.

Accordingly, while the first array test switches AT_SW1 and the first data switches SW1 are turned on, the plurality of probe pin(s) 300 in the array test apparatus contact the array test pads ATP, and apply the array test signals AT_DATA to a first group, such as, for example, a first column, a 9th column, a 17th column . . . , of the pixel unit 110, via the array test pads ATP.

The scanning driving power sources VDDNSS and the scanning control signal SCS are transmitted to the scanning driving unit 120. The scanning driving unit 120 may then sequentially generate scanning signals, and transmit the scanning signals to the pixel unit 110. Accordingly, the array test signal AT_DATA is supplied to a pixel circuit of pixels.

Then, the plurality of probe pin(s) 300 in the array test apparatus may contact the array test pads ATP again. In response to the applied array test signal AT_DATA, a signal (e.g., a current), which is output from the first group, is detected, and thus, a defective pixel may be detected.

Likewise, while the second array test switches AT_SW2 and the first data switches SW1 are turned on, the array test signal AT_DATA may be applied to a second group, such as, for example, a third column, an 11th column, a 19th column . . . , of the pixel unit 110, via the array test pads ATP. Then, a signal (e.g., a current) which is output from the second group, is detected via the array test pads ATP, and thus, a defective pixel may be detected.

Likewise, while the array test switches AT_SW1 through AT_SW4 and the first and second data switches SW1 and SW2 are selectively turned on, the array test signal AT_DATA may be applied to each column of pixels of the pixel unit 110. Then, a signal (e.g., a current) is detected, and thus, a defective pixel may be detected.

In the exemplary embodiment described above, the first and second data switches SW1 and SW2 are sequentially turned on. However, exemplary embodiments of the present invention are not limited thereto. For example, if the adjacent pixel columns do not share one data line, the array test S2 may be executed simultaneously on the adjacent pixel columns by simultaneously turning on the first and second data switches SW1 and SW2. Additionally, the timing regarding when the first and second data switches SW1 and SW2 and the array test switches AT_SW1 through AT_SW4 are turned on is not fixed, and may be varied.

According to an exemplary embodiment of the present invention, an array test unit, which consists of a 4:1 demultiplex circuit, has been described. However, exemplary embodiments of the present invention are not limited thereto. For example, in response to utilizing different panel designs or different array test apparatuses, a demultiplex circuit having various sizes such as, for example, 2:1, 3:1, 4:1, 5:1, etc., may be configured by adjusting the space between the array test pads ATP.

Figure 5:
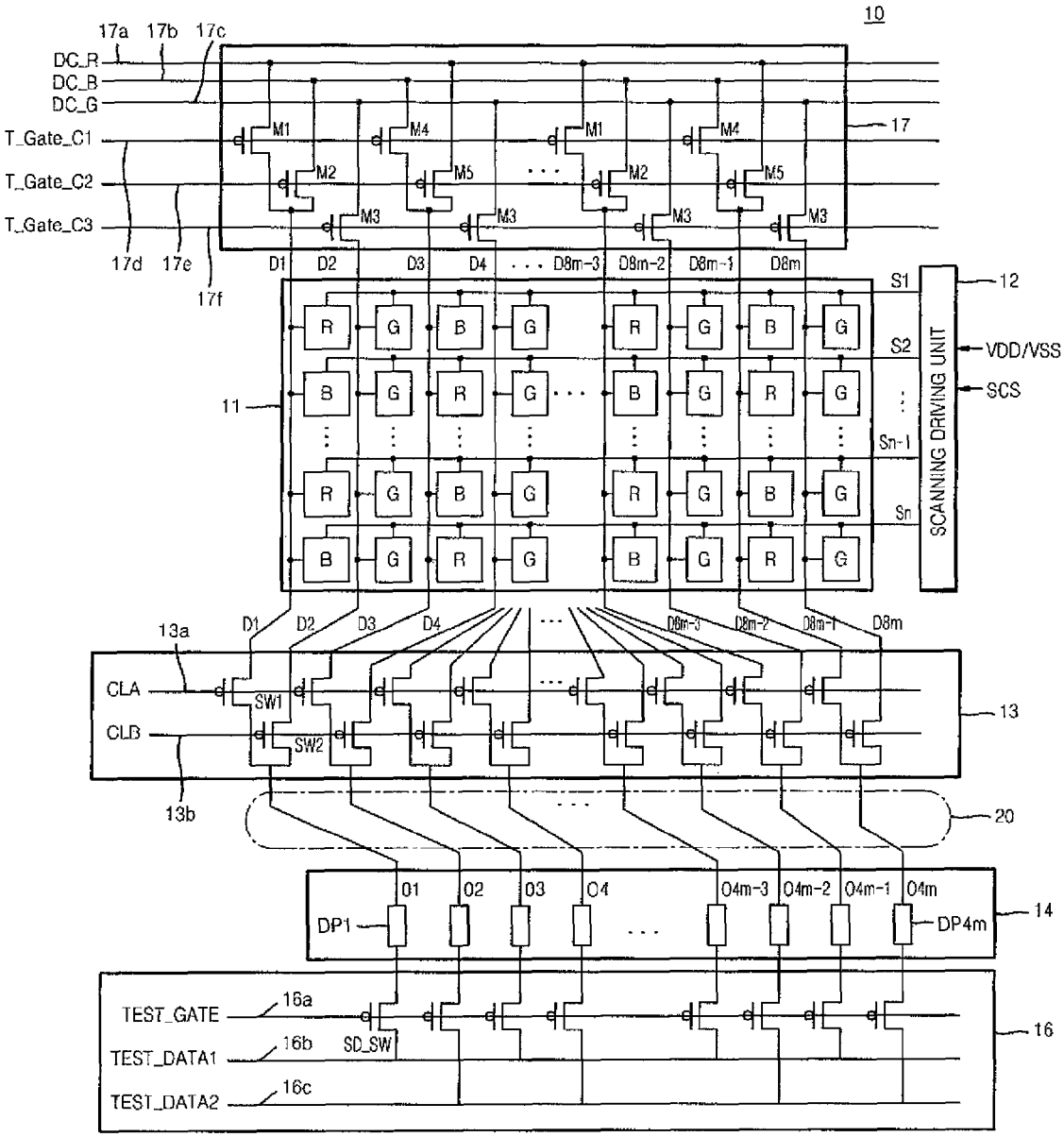
FIG. 5 is a plan view illustrating a comparative example corresponding to the organic light-emitting display panel according to exemplary embodiments of the present invention.

FIG. 5 is a plan view illustrating a comparative example corresponding to the organic light-emitting display panel according to exemplary embodiments of the present invention.

Referring to FIG. 5, according to a comparative example, an organic light-emitting display panel 10 includes a pixel unit 11, a scanning driving unit 12, a data switch unit 13, an IC mounting area 14, a line test unit 16, and a panel test unit 17.

The pixel unit 11 includes first pixels, second pixels, and third pixels that respectively emit light of different colors from each other. The pixel unit 11 has a structure in which the first and second pixels are alternately arranged in the same column, and the third pixels are disposed in-line in a column that is adjacent to the column in which the first and second pixels are arranged. For example, the first pixels may be red pixels R that emit red light, the second pixels may be blue pixels B that emit blue light, and the third pixels may be green pixels G that emit green light. An arrangement of the pixels in the pixel unit 11 shown in FIG. 5 is the same as that of the pixel unit 110 shown in the exemplary embodiment of FIG. 4. Thus, a detailed description thereof is omitted.

The data switch unit 13 is disposed between the data lines D1 through D8*m* and the output lines O1 through O4*m* in the IC mounting area 14. The data pads DP are bonded and electrically connected to the data driving unit by using, for example, a COG method. The data switch unit 13 includes the first data switches SW1 that are disposed between the first data lines D1, D3, . . . , D8*m*−1 and the output lines O1 through O4*m*, the first data lines D1, D3, . . . , D8*m*−1 being arranged in a column in which the red pixels R and the blue pixels B are alternately arranged, and the second data switches SW2 that are disposed between the second data lines D2, D4, . . . , D8*m* and the output lines O1 through O4*m*, the second data lines D2, D4, . . . , D8*m* being arranged in a column in which the green pixels G are arranged. Gates of the first data switches SW1 are connected in common to a line 13*a* that supplies the first data control signal CLA. Gates of the second data switches SW2 are connected in common to a line 13*b* that supplies the second data control signal CLB.

When the organic light-emitting display panel 10 operates normally, the first data switches SW1 and the second data switches SW2 in the data switch unit 13 are alternately turned on according to the first data control signal CLA and the second data control signal CLB. Then, the first data switches SW1 and the second data switches SW2 may transmit data signals, which are supplied from the data driving unit in the IC mounting area 14, to the pixel unit 11.

The line test unit 16 includes a plurality of line test switches SD_SW for executing a short or open test on lines in the fan-out unit 20. Gates of the line test switches SD_SW are connected in common to a line 16*a* that supplies the line test control signal TEST_GATE. A first terminal of each of the line test switches SD_SW is connected to the data pads DP in the IC mounting area 14. Second terminals of the odd-numbered line test switches SD_SW are connected in common to a line 16*b* that supplies the first line test signal TEST_DATA1. Second terminals of the even-numbered line test switches SD_SW are connected in common to a line 16*c* that supplies the second line test signal TEST_DATA2. The line test switches SD_SW receive the line test control signal TEST_GATE for maintaining a turned-on state during a line test, and correspondingly, the line test unit 16 is maintained in a turned-on state. Additionally, the first line test signal TEST_DATA1 is supplied to the odd-numbered line test switches SD_SW, and the second line test signal TEST_DATA2 is supplied to the even-numbered line test switches SD_SW. The first line test signal TEST_DATA1 may be white data for displaying the color white, and the second line test signal TEST_DATA2 may be black data for displaying the color black. By supplying a different signal to adjacent lines in the fan-out unit 20, a short between the adjacent lines or an open in each line in the fan-out unit 20 may be detected.

The panel test unit 17 includes a plurality of panel test switches M1 through M5 for a panel test. Gates of the first panel test switches M1 and the fourth panel test switches M4 are connected in common to a line 17*d* that supplies a first panel test control signal T_Gate_C1. Gates of the second panel test switches M2 and the fifth panel test switches M5 are connected in common to a line 17*e* that supplies the second panel test control signal T_Gate_C2. Gates of the third panel test switches M3 are connected in common to a line 17*f* that supplies a third panel test control signal T_Gate_C3. The panel test switches M1 through M5 are further connected to panel test signal lines 17*a*, 17*b* and 17*c*.

The red pixels R and the blue pixels B are connected to one data line. The first panel test switches M1 and the fourth panel test switches M4, and the second panel test switches M2 and the fifth panel test switches M5, are alternately turned on/off, according to the first panel test control signal T_Gate_C1 and the second panel test control signal T_Gate_C2. Thus, a red test signal DC_R and a blue test signal DC_B are respectively supplied to the red pixels R and the blue pixels B. If the third panel test switches M3 are turned on according to the third panel test control signal T_Gate_C3, a green test signal DC_G is supplied respectively to the green pixels G.

With regard to the organic light-emitting display panel 10 of FIG. 5, the line test unit 16 is directly connected to the data pads DP in the IC mounting area 14. Accordingly, in order to detect a short between adjacent lines or an open in each line in the fan-out unit 20, two line test signals TEST_DATA1 and TEST_DATA2 are used.

Additionally, the organic light-emitting display panel 10 of FIG. 5 does not include an additional circuit unit that executes an array test. Thus, prior to a cell process, an array test with respect to pixel circuits is not executed using the circuit unit. Additionally, in order to execute an array test, a contact between the data pads DP in the IC mounting area 14 and an array test apparatus is used. However, as the resolution of a display apparatus is increased, and thus, the number of pixels and the number of data lines are increased, the number of the data pads DP is also increased. Accordingly, a size of the data pads DP becomes small, and a space between the data pads DP (e.g., a pitch) becomes narrow. Therefore, a probe pin(s) 300 of an array test apparatus and the data pads DP may not contact each other on a one-to-one basis.

In contrast, as illustrated in FIG. 4, according to an exemplary embodiment of the present invention, the organic light-emitting display panel 100 includes the array test unit 150 for executing the array test S2 between the IC mounting area 140 and the line test unit 160. The array test unit 150 includes a demultiplexer 152 that includes a plurality of array test switches AT_SW1 through AT_SW4. Thus, by connecting two or more data pads DP to each other, one array test pad ATP is formed. Accordingly, by reducing the number of the array test pads ATP and forming the array test pads ATP to be larger than the data pads, array test pads ATP having a sufficient size for testing may be formed, and a pitch between the array test pads ATP may be widened. Therefore, the probe pin(s) 300 in the array test apparatus may contact the array test pads ATP on a one-to-one basis, and contact accuracy may be improved during execution of an array test.

Additionally, according to an exemplary embodiment of the present invention, the organic light-emitting display panel 100 selectively turns on a plurality of array test switches AT_SW1 through AT_SW4. Thus, even when only one line test signal TEST_DATA is supplied to the line test unit 160, the organic light-emitting display panel 100 may supply different signals to the adjacent lines in the fan-out unit 200, and thus, may detect a short between the adjacent lines or an open in each line in the fan-out unit 200. Accordingly, the number of pads which supply a line test signal may be reduced.

Figure 6:
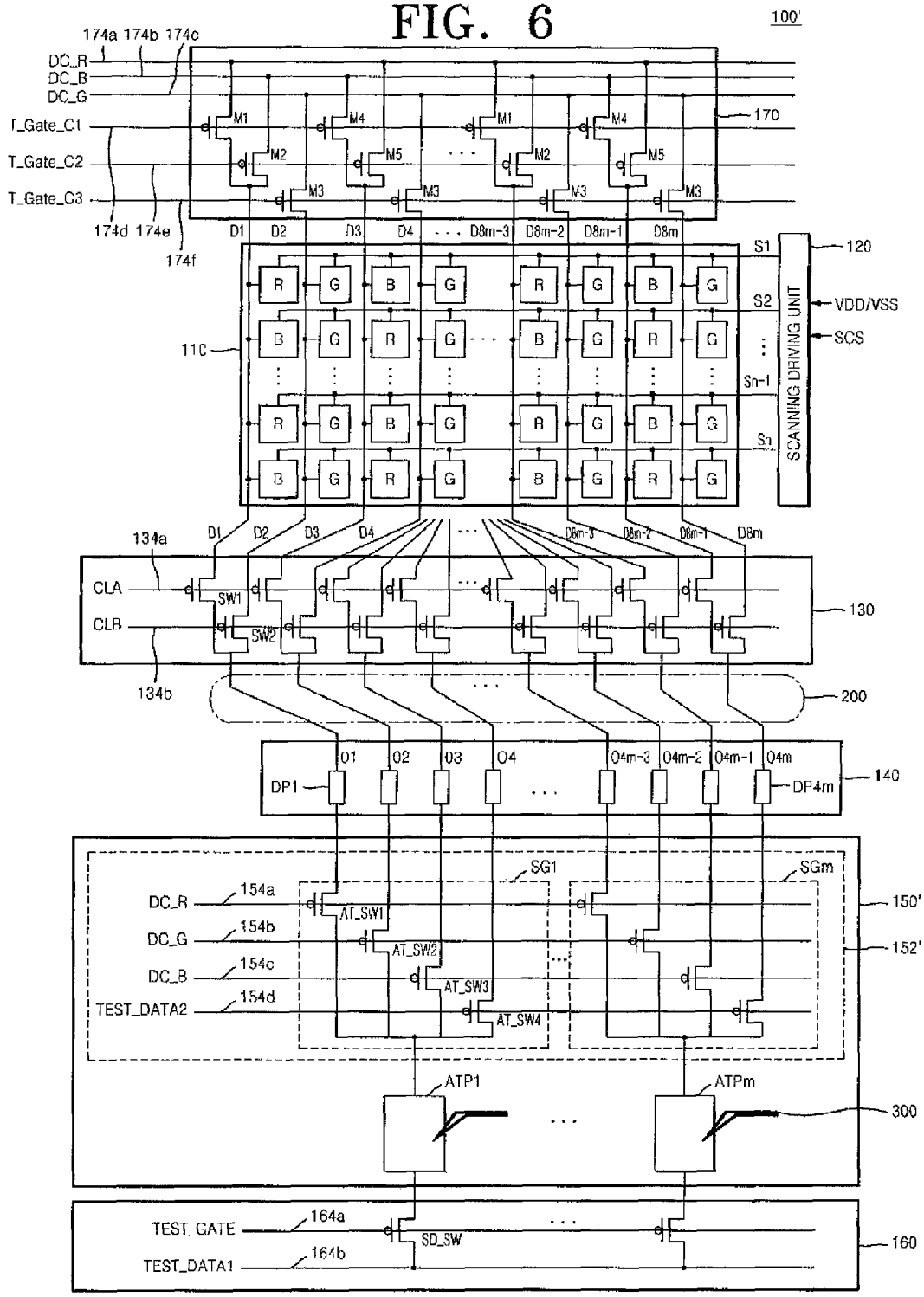
FIG. 6 is a plan view illustrating an exemplary embodiment of the organic light-emitting display panel of FIG. 2.

FIG. 6 is a plan view illustrating an exemplary embodiment of the organic light-emitting display panel of FIG. 2.

Referring to FIG. 6, an organic light-emitting display panel 100' is to the same as the organic light-emitting display panel 100 of FIG. 4, except than that the organic light-emitting display panel 100' employs a red test signal DC_R, a blue test signal DC_B, a green test signal DC_G (e.g., DC signals) and an existing second line test signal TEST_DATA2 as the first through fourth array test control signals AT_A through AT_D that are applied to a demultiplexer 152' in an array test unit 150'. For convenience of explanation, a detailed description of elements and operations previously described with reference to FIG. 4 may be omitted.

In order to drive the array test unit 150 in the organic light-emitting display panel 100 shown in FIG. 4, four signals, including the first through fourth array test control signals AT_A through AT_D, are utilized. Accordingly, pads P are further provided to supply the first through fourth array test control signals AT_A through AT_D.

In contrast, according to the exemplary embodiment of FIG. 6, the array test unit 150' in the organic light-emitting display apparatus 100' employs the red test signal DC_R, the blue test signal DC_B, and the green test signal DC_G as three array test control signals AT_A through AT_C from among the first through fourth array test control signals AT_A through AT_D. The array test unit 150' further employs one of two line test signals TEST_DATA1 and TEST_DATA2 which are supplied to the line test unit 16 shown in FIG. 5. For example, in FIG. 6, the second line test signal TEST_DATA2 is utilized. In an exemplary embodiment, the line test signal TEST_DATA1 may be utilized instead of TEST_DATA2. That is, in FIG. 6, each of the first through fourth array test control signal lines 154*a* through 154*d* is electrically connected to the first through third panel test signal line 174*a* through 174*c* and the line test signal line 164*b*, and thus, may receive a test control signal from each of the lines. The first through third panel test control signals T_Gate_C1 through T_Gate_C3 maintain the first through fifth panel test switches M1 through M5 in a turned-off state. Additionally, the line test control signal TEST_GATE maintains the line test switches SD_SW in a turned-off state.

For example, when a distance between the pads P in the pad unit 180 is about 300 μm, if four pads P for four array test control signals are added, an additional minimum distance of about 1200 μm is needed. However, according to the exemplary embodiment of the present invention shown in FIG. 6, the organic light-emitting display apparatus 100' employs test signals which have previously been used as an array test control signal. Accordingly, in an exemplary embodiment, a pad for supplying an additional signal for an array test is not necessary.

Accordingly, according to exemplary embodiments of the present invention, even though the resolution of a display may be increased and a space for forming a pad in a pad unit may be insufficient, an array test may be executed without having to provide an additional space for forming a pad.

According to exemplary embodiments of the present invention, an array test may be executed by forming a demultiplexer and a test pad, which is larger than a data pad, in a space below the COG mounting area. Thus, a defect(s) in a pixel(s) may be detected and a determination of whether an array process is normal may be made. Accordingly, a defect(s) may be quickly repaired.

Additionally, by using signals employed for a panel test and a line test as control signals for an array test, an array test may be executed without having to form additional signal input pads.

While the present invention has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. An organic light-emitting display panel, comprising:

a panel test unit connected to first ends of a plurality of data lines, and configured to output a panel test signal for testing a plurality of pixels;

a plurality of data pads connected to second ends of the plurality of data lines;

an array test unit configured to selectively apply a plurality of array test signals to a pixel column of a pixel unit according to a plurality of array test control signals, and detect a signal output from the pixel column to which the plurality of array test signals are applied, wherein the array test unit comprises a plurality of array test pads configured to receive the array test signals, and each array test pad is connected to a different group of data pads from among the plurality of data pads; and a line test unit configured to output a line test signal for testing for an open or a short at the second ends of the data lines.

2. The organic light-emitting display panel of claim 1, wherein the plurality of array test control signals comprise the panel test signal and the line test signal.

3. The organic light-emitting display panel of claim 2, wherein the line test unit comprises a plurality of line test switches having gates connected in common to a line that supplies a line test control signal, first terminals respectively connected to the plurality of array test pads, and second terminals configured to receive the line test signal.

4. The organic light-emitting display panel of claim 1, wherein the array test unit comprises:

a demultiplexer configured to connect the array test pads to the different groups of data pads, and selectively transmit the plurality of array test signals to the plurality of data pads according to the plurality of array test control signals.

5. The organic light-emitting display panel of claim 4, wherein the demultiplexer comprises a plurality of array test switches, each having a gate connected to one of a plurality of lines that transmit the plurality of array test control signals, a first terminal connected to one of the plurality of data pads, and a second terminal connected to one of the plurality of array test pads.

6. The organic light-emitting display panel of claim 5, wherein the plurality of array test switches comprise:

a plurality of first array test switches having gates connected in common to a line that supplies a first array test control signal front among the plurality of array test control signals;

a plurality of second array test switches having gates connected in common to a line that supplies a second array test control signal from among the plurality of array test control signals;

a plurality of third array test switches having gates connected in common to a line that supplies a third array test control signal from among the plurality of array test control signals; and a plurality of fourth array test switches having gates connected in common to a line that supplies a fourth array test control signal from among the plurality of array test control signals.

7. The organic light-emitting display panel of claim 4, wherein the demultiplexer comprises a plurality of switch groups that connect sequential data pads from among the plurality of data pads to one array test pad from among the plurality of array test pads, wherein a number of the sequential data pads is the same as a number of the array test control signals, and each switch group comprises a plurality of array test switches, each having a gate connected to a line that supplies one of the array test control signals, and the plurality of array test switches in each switch group is configured to be sequentially turned on in response to the plurality of array test control signals.

8. The organic light-emitting display panel of claim 1, wherein the line test unit is maintained in an OFF state while the array test unit executes an array test.

9. The organic light-emitting display panel of claim 1, further comprising a data switch unit configured to selectively apply a plurality of data signals to a plurality of pixel columns of the pixel unit, wherein the plurality of data signals are output by the plurality of data pads and the pixel column is one of the plurality of pixel columns.

10. The organic light-emitting display panel of claim 1, further comprising a data driving unit bonded to the plurality of data pads via a chip-on-glass (COG) method, and configured to apply a plurality of data signals to the plurality of data lines.

11. An organic light-emitting display panel, comprising:

a plurality of array test pads configured to receive an array test signal; and demultiplexer disposed between a plurality of data pads and the plurality of array test pads, and configured to selectively apply the array test signal to a pixel column of a pixel unit via the plurality of data pads according to a plurality of array test control signals, wherein each array test pad is connected to a different group of data pads from among the plurality of data pads via the demultiplexer, wherein the plurality of data pads are connected to a plurality of data lines of the pixel unit, and the array test signal is output by the plurality of array test pads.

12. The organic light-emitting display panel of claim 11, further comprising:

a panel test unit configured to output a panel test signal to test pixels of the organic light-emitting display panel; and a line test unit configured to output a line test signal to test for an occurrence of a short or an open at the plurality of data lines, wherein the plurality of array test control signals comprise the panel test signal and the line test signal.

13. The organic light-emitting display panel of claim 12, wherein the line test unit comprises a plurality of line test switches having gates connected in common to a line that supplies the line test control signal, first terminals respectively connected to the plurality of array test pads, and second terminals configured to receive the line test signal.

14. The organic light-emitting display panel of claim 12, wherein the line test unit is maintained in an OFF state while an array test is executed.

15. The organic light-emitting display panel of claim 11, wherein the demultiplexer comprises a plurality of array test switches, each having a gate connected to one of a plurality of lines that transmit the plurality of array test control signals, a first terminal connected to one of the plurality of data pads, and a second terminal connected to one of the plurality of array test pads.

16. The organic light-emitting display panel of claim 15, wherein the plurality of array test switches comprise:

a plurality of first array test switches having gates connected in common to a line that supplies a first array test control signal from among the plurality of array test control signals;

a plurality of second array test switches having gates connected in common to a line that supplies a second array test control signal from among the plurality of array test control signals;

a plurality of third array test switches having gates connected in common to a line that supplies a third array test control signal from among the plurality of array test control signals; and a plurality of fourth array test switches having gates connected in common to a line that supplies a fourth array test control signal from among the plurality of array test control signals.

17. The organic light-emitting display panel of claim 11, wherein each of the plurality of array test pads has a larger size than each of the plurality of data pads, and a space between each of the plurality of array test pads is wider than a space between each of the plurality of data pads.

18. The organic light-emitting display panel of claim 11, further comprising a data switch unit configured to selectively apply a plurality of data signals to a plurality of pixel columns of the pixel unit, wherein the plurality of data signals are output by the plurality of data pads, and the pixel column is one of the plurality of pixel columns.

19. The organic light-emitting display panel of claim 11, further comprising a data driving unit bonded to the plurality of data pads via a chip-on-glass (COG) method, and configured to apply a plurality of data signals to the plurality of data lines.

20. An organic light-emitting display panel, comprising:

a plurality of array test pads configured to receive an array test signal; and a demulltiplexer disposed between a plurality of data and the plurality of array test pads, and configured to selectively apply the array test signal to a pixel column of a pixel unit via the plurality of data pads according to a plurality of array test control signals, wherein the plurality of data pads are connected to a plurality of data lines of the pixel unit and the array test signal is output by the plurality of array test pads, wherein the demultiplexer comprises a plurality of switch groups that connect sequential data pads from among the plurality of data pads to one array test pad from among the plurality of array test pads, wherein a number of the sequential data pads is the same as a number of the array test control signals, wherein each switch group comprises a plurality of array test switches, each having a gate connected to a line that supplies one of the plurality of array test control signals, and the plurality of array test switches in each switch group is configured to be sequentially turned on in response to the plurality of array test control signals.

* * * * *